US005735695A

United States Patent [19]

Heinrich

[11] Patent Number: 5,735,695

[45] Date of Patent: Apr. 7, 1998

[54] ELECTRICAL CABLE CONNECTING DEVICE

[75] Inventor: Dirk Heinrich, Hamburg, Germany

[73] Assignee: Minnesota Mining and Manufacturing Company, Saint Paul, Minn.

[21] Appl. No.: 649,375

[22] Filed: May 17, 1996

[30] Foreign Application Priority Data

Jun. 21, 1995 [EP] European Pat. Off. ..... 95201678

[51] Int. Cl.[6] ..... H01R 9/09

[52] U.S. Cl. ..... 439/63; 439/581

[58] Field of Search ..... 439/63, 581, 78, 439/516, 885, 55, 875, 876, 891

[56] References Cited

U.S. PATENT DOCUMENTS

| | | | |
|---|---|---|---|
| 3,383,457 | 5/1968 | Schumacher et al. | 439/63 |
| 3,514,737 | 5/1970 | Renshaw, Jr. | 439/63 |
| 3,743,748 | 7/1973 | Reeder | 174/75 C |
| 4,060,877 | 12/1977 | De Groef | 29/626 |
| 4,605,269 | 8/1986 | Cohen et al. | 339/17 LC |
| 5,246,384 | 9/1993 | Sato | 439/581 |

FOREIGN PATENT DOCUMENTS

| | | | |
|---|---|---|---|
| 0412412 A1 | 2/1991 | European Pat. Off. | H01R 17/12 |
| 0462879 A1 | 12/1991 | European Pat. Off. | 439/581 |
| 0139876 | 5/1990 | Japan | 439/63 |
| 0138872 | 6/1991 | Japan | 439/63 |
| 2025161 | 1/1980 | United Kingdom | H01R 11/00 |
| 2194181 | 3/1988 | United Kingdom | 439/63 |
| 2244870 | 12/1991 | United Kingdom | 439/581 |
| WO 93/21669 | 10/1993 | WIPO . | |

*Primary Examiner*—Gary F. Paumen
*Assistant Examiner*—Tho D. Ta
*Attorney, Agent, or Firm*—Matthew B. McNutt

[57] ABSTRACT

A device for electrically connecting at least one cable having at least two conductive members to another electrical component. The device has at least first and second connection members. The first connection member includes a first portion electrically connected to a first conductive member of the cable and a second portion electrically connected to the first portion and electrically connectable to a further electrical component. The second connection member includes a third portion electrically connected to a second conductive member of the cable and a fourth portion electrically connected to the third portion and electrically connectable to the further electrical component. The device further has a joining portion made from electrically conductive material which electrically connects the first and third portions of the first and second connection members, respectively. The first and third portions are adapted to conform to and substantially surround the circumference of the first and second conductive members of the cable.

15 Claims, 14 Drawing Sheets

ELECTRICAL CABLE CONNECTING DEVICE

This invention relates to electrical connectors and in particular to connectors for forming electrical connections to cables having at least two conducting members, such as coaxial cables. The electrical connecting device in accordance with the invention is particularly suitable for use in connecting cables to printed circuit boards or transmission line assemblies. The electrical connecting device in accordance with the invention is particularly suitable for use in connecting micro-electronic devices such as micro-coaxial equipment. The present invention further relates to a method of installing the electrical connecting device as well as apparatus for installing the electrical connecting device.

A connector for connecting a coaxial cable to a printed circuit board (PCB) or other electrical equipment is known from WO 93/21669. This known device includes a piece of wire which is bent so that the conductors of the cable may be connected to one end of the wire respectively by means of solder. After the wire has been connected to the coaxial cable, the central portion of the wire is snipped off so that the remaining parts of the wire may act as pins for insertion into a PCB or other device. The connector includes one or more heat-shrinkable sleeves and solder materials, such that when the heat-shrinkable sleeves are completely recovered, the conductor and screen of the coaxial cable are soldered to respective ends of the wire, the individual lengths of the wire are insulated from each other, and the cable is mechanically supported by the shrink tubing. The connector is made up of several separate components and is therefore costly to manufacture.

A modification is known to the above device from U.S. Pat. No. —4,060,887 in which two separate wire pieces are used and are slidable with respect to each other to accommodate different hole spacing in a PCB.

Another connecting device is known from GB-2 025 161. This device includes a flat metal plate which is connected to the cable screen. A hole in the plate is provided, so that the central conductor of the coaxial cable may pass through and be connected to a printed circuit board.

A further connector is known from EP-0 412 412. This connector has a connector body, comprising an outer contact member and an inner contact member electrically isolated from the outer contact member and adapted to be connected to the internal conductor of a coaxial cable. The outer contact member cooperates with an adapter and a sleeve portion for connecting to the screen of the coaxial cable.

U.S. Pat. No. —4,605,269 discloses a printed circuit board header for a row of coaxial sockets, comprising a dielectric housing having a series of passageways extending therethrough, in which coaxial sockets are releasably disposed. Each coaxial socket housing includes latching sections, latchably engaging flexible latching members of a coaxial plug housing matable with the coaxial socket housing, so that the coaxial plugs are electrically matable with the respective coaxial sockets.

U.S. Pat No.—3,743,748 discloses a terminating device for connecting a shielded cable to a printed circuit board. The device has a shaped, conductive clip having at its first end a first connector for connection to the shield of a coaxial cable. The other end of the clip has a connector for electrical connection to the central conductor of the coaxial cable. The two ends are temporarily connected by a removable tab. Heat shrinkable sleeves with solder inserts may be advantageously attached to this clip to help secure the connections between the cable and the clip and to help prevent undesired electrical contact. The device consists of several individual components and is therefore costly to produce.

SUMMARY OF THE INVENTION

In accordance with a first aspect of the invention a device for electrically connecting at least once cable having at least two conductive members to another electrical component is provided, said device compromising:

at least first and second connection members, said first connection member including: a first portion electrically connectable to a first conductive member of the cable: and a second portion electrically connected to said first portion and electrically connectable to the further electrical component; said second connection member including:

a third portion electrically connectable to a second conductive member of the cable; and a fourth portion electrically connected to said third portion and electrically connectable to the further electrical component; and said device further comprising:

a joining portion made from electrically conductive material and electrically connecting said first and third portions;

at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being securable and electrically connectable to the respective one of said first and third portions.

According to a second aspect of the invention a device for electrical connection to another electrical component is provided, said device comprising:

a cable having at least two conductive members; at least first and second connection members, said first connection member including:

a first portion electrically connected to a first conductive member of the cable; and a second portion electrically connected to said first portion and electrically connectable to the further electrical component; said second connection member including:

a third portion electrically connected to a second conductive member of the cable; and a fourth portion electrically connected to said third portion and electrically connectable to the further electrical component; and said device further comprising:

a joining portion made from electrically conductive material and electrically connecting said first and third portions;

at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being secured and electrically connected to the respective one of said first and third portions.

Device according to the first or second aspect, wherein the attachment of said fifth portion to the respective one of said first and third portions is a substantially permanent connection.

Device according to any of aspects 1 to 3, wherein said first connection member further includes: a sixth portion connecting said first and second portions, said joining portion connecting one or both of said first and sixth portions to said third portion.

Device according to any of aspects 1 to 4, wherein said second connection member further includes: a seventh portion connecting said third and fourth portions, said joining portion connecting one or both of said first and sixth portions to one or both of said third and seventh portions.

Device according to any of aspects 1 to 5, wherein said first and second portions and said joining portion are adapted for holding said second and fourth portions in a predetermined spatial relationship to each other.

Device according to aspect 4 or 5, wherein said joining portion and said sixth and/or said seventh portion are adapted to hold said second and fourth portions in a predetermined spatial relationship to each other.

In accordance with an eighth aspect of the invention a device for electrically connecting at least one cable having at least two conductive members to another electrical component is provided, said device comprising:

at least first and second connection members, said first connection member including:

a first portion electrically connectable to a first conductive member of the cable; and a second portion electrically connected to said first portion and electrically connectable to the further electrical component; said second connection member including:

a third portion electrically connectable to a second conductive member of the cable; and a fourth portion electrically connected to said third portion and electrically connectable to the further electrical component; and said device further comprising:

ends of said first and third portions remote from said second and fourth portions being fixed to a joining portion, said joining portion holding said first and second connection members in a predetermined spatial relationship to each other; at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being securable and electrically connectable to the respective one of said first and third portions.

Device according to any of aspects 1 to 8, wherein said joining portion is adapted to provide strain relief for the cable.

Device according to aspects 8 or 9, wherein said joining portion is made from a conductive material.

Device according to any of aspects 1 to 7 or 10, wherein said electrically conductive material is a metal.

Device according to any of aspects 1 to 11, wherein said joining portion is separable from said first and second connection members.

Device according to any of aspects 1 to 12, wherein said second and fourth portions are elongate members, each elongate member comprises a first pin and a second pin, one end of each first pin being connected to the respective one of said first and third portions, and the other end of each first pin being joined to one end of one said second pin, and said fifth portion is joined to the other end of the respective ones of said second pins.

Device according to any of aspects 1 to 12, wherein said second and fourth portions are elongate members, each elongate member comprising a first pin and a second pin, one end of each first pin being connected to the respective one of said first and third portions, said fifth portion comprises eighth and ninth portions and said eighth and ninth portions are connected to the ends of respective second pins.

Device according to any of aspects 1 to 14, wherein at least one of said second and fourth portions includes a protrusion which prevents connection to the another electrical component.

Device according to any of aspects 1 to 15, Wherein said second and fourth portions are connected to the another electrical component.

Device according to aspect 16, wherein said joining portion is removed.

Device according to aspect 16 or 17, wherein the another electrical component is a printed circuit board.

Device according to any of aspects 1 to 18, wherein said device is a microelectronic device.

In accordance with a twentieth aspect of the invention a method of connecting a device to a cable and a further electrical component is provided, said device comprising:

at least first and second connection members, said first connection member including:

a first portion electrically connectable to a first conductive member of the cable; and a second portion electrically connected to said first portion and electrically connectable to the further electrical component; said second connection member including:

a third portion electrically connectable to a second conductive member of the cable; and a fourth portion electrically connected to said third portion and electrically connectable to the further electrical component; and said device further comprising:

a joining portion made from electrically conductive material and electrically connecting said first and third portions;

at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being securable and electrically connectable to the respective one of said first and third portions;

the method including the steps of:

connecting a cable to said first, third and fifth portions including the step of joining the fifth portion to the respective ones of the first and third portion; and connecting the further electrical component to said second and fourth portions; followed by the step of removing said joining portion.

In accordance with a twenty first aspect of the present invention an apparatus for installing a connecting device in accordance with any of the aspects 2 to 15 is provided, comprising:

means for holding the joining portion;

means for inserting the connecting device in the further electrical component; and means for removing the joining portion from the connecting device.

Apparatus according to aspect 21, wherein said means for removing includes means for storing the cut-off joining portions.

Apparatus according to aspect 21 or 22; further comprising means to remove a protrusion on one of the first or second connecting members.

The invention may provide the advantage of a connecting device with few individual components.

The invention may provide the advantage of a connector whose connecting surfaces are easily accessible for joining purposes.

The invention may provide the advantage of a connecting device with which it is not necessary to push cable with easily splayed, braided screens through narrow openings such as heat shrinkable tubing.

The invention may provide a connector and cable assembly which may be soldered to a PCB or similar electrical component without loosening or deterioration of the cable/connector connections.

The invention may provide the advantage of reducing cost.

The invention may also provide the advantage of providing a connector with strain relief for the cable.

The invention may also provide the advantage of static control of electronic components attached to the cable or further electrical component.

The invention may also provide the advantage of reducing the space required on a printed circuit board for the connection of the board to a cable.

The dependent claims describe further embodiments of the invention.

The invention, its embodiments and modifications are described in the following with reference to the drawings.

DESCRIPTION OF THE PREFERRED EMBODIMENTS

The invention will be described generally in the following with reference to connecting coaxial cables to PCBS. The invention is not limited thereto. The connecting device in accordance with the invention may be used for connecting any type of cable having at least two conductive members to any other electronic equipment or electronic components or transmission lines or the like.

Further, the figures a schematic representations only and certain parts are shown larger in size for clarity purposes.

Figure 1:
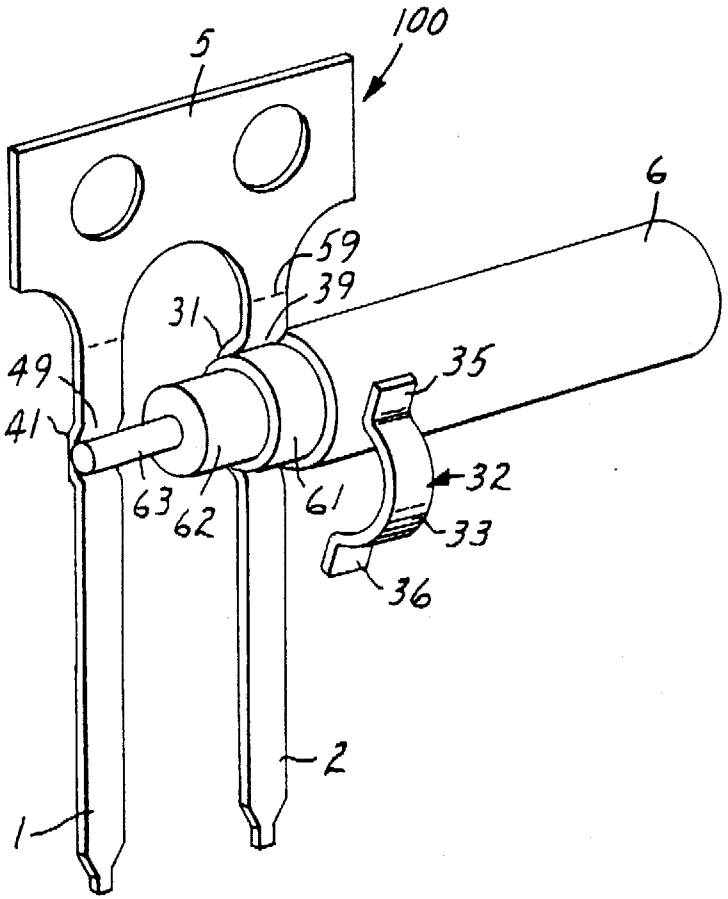
FIG. 1 shows a connecting device in accordance with a first embodiment of the present invention.

FIG. 1 shows a connecting device 100 in accordance with a first embodiment of the present invention. Connecting device 100 is made from a conducting material, preferably a metal such as copper or copper alloys such as copper/zinc, beryllium/copper, phosphor-bronze, or any other metal suitable for producing electrical contacts. The metal may also be plated with other materials such as nickel or silver. The connecting device 100 is designed in such a way that it may be produced from sheet metal by stamping, cutting and bending. The invention is however not limited to this method of manufacture. The connecting device 100 may be produced by any other manufacturing method which is suitable, for example pressure die casting. Connecting device 100 may comprise two connecting members 1,41, 42;2,31,32 whereby the number of connecting members 1,41,42;2,31,32 may be equal to the number of conductive members in the cable or cables. Connecting device 100 has two or more elongate members 1,2 which are sized and spaced so that they fit into the standard holes on a PCB. Elongate members 1,2 are portions of the connecting device 100 which are connectable to a PCB or any other electrical component or device. Connecting portions 31,41 are joined to, and may be integral with ends of elongate members 1,2 and are provided for attaching the screen of a coaxial cable to surface 39 of the connecting portion 31 and for attaching the signal conductor of the coaxial cable to surface 49 of the connecting portion 41. Joining portion 5 of the connecting device 100 connects connecting portions 31 and 41 together and holds elongate members 1 and 2 in a predetermined spatial relationship to each other while leaving connecting surfaces 39,49 exposed. Joining portion 5 may be provided with mechanical weak points 59 so that it may be broken off at a later stage of the installation process.

Figure 2:
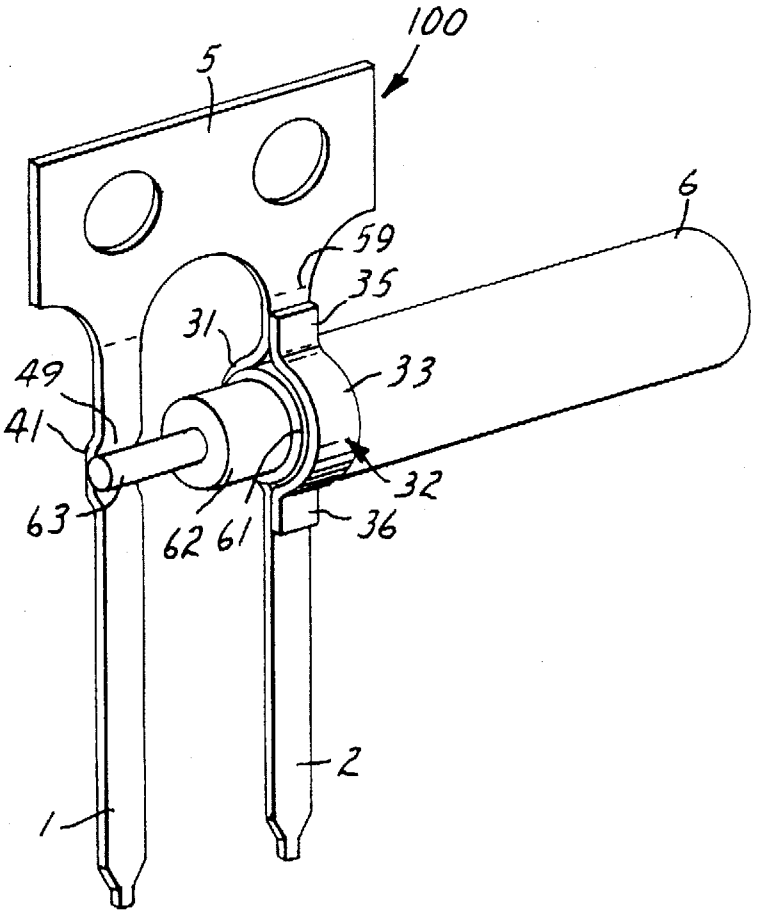
FIG. 2 shows the connecting device of FIG. 1, attached to a coaxial cable.

Connecting portions 31 and 41 are preferably shaped to conform to a part of the outer surface of the coaxial cable screen and signal conductor respectively. In particular, the connecting portions 31,41 may be wider than the elongate members 1,2 and may be of arcuate shape having a radius adapted to the radius of the coaxial cable to be jointed. The shape of connecting portions 31,41 may take numerous configurations as long as they present a sufficient conductive surface to cooperate with further connecting portions 32,42 for electrical connection to the cable screen or signal conductor respectively. The signal conductor and screen of the coaxial cable may be connected to the surfaces 39,49 by soldering, welding or any other suitable attachment method which provides and maintains electrical contact between the screen, the signal conductor and the connecting device 100. For instance, the connecting portions 31,41 may be provided with extensions for crimping to the coaxial cable. Further connecting portion 32 (only further connecting portion 32 is shown in FIG. 1, however connecting portion 42 may be similar but adapted to the smaller diameter of the signal conductor.) may be a bridge piece as shown in FIG. 1 which has an arcuate portion 33 adapted to the diameter of the cable screen (or the signal conductor respectively for further connecting portion 42) as well as fixing portions 35 and 36 on either side of the arcuate portion 33 for attachment to connecting portions 31. Bridge piece 32,42 may be secured and electrically connected to the respective one of connecting portions 31,41 by welding, spot-welding, soldering or crimping or by any other suitable method. An attachment method is preferred which does not involve soldering. In terms of this application, welding, spot welding and crimping are examples of attachment methods which produce a substantially permanent connection between the further connecting portions 32,42 and either one of connecting portions 31,41 according to any of the embodiments of the invention. In terms of this application, a substantially permanent connection is one which is not weakened or loosened by the subsequent step of soldering elongate members 1,2 to a PCB, transmission line or similar electrical component even when the soldering procedure is carried out incorrectly, e.g. for an excessively long time or at an excessively high temperature which may melt high temperature solder and cause splitting of heat shrinkable tubing. The connecting device 100 is shown connected to a coaxial cable 6 in FIG. 2. The coaxial cable is prepared so as to expose a suitable length of signal conductor 63 and screen 61. Cable insulation 62 may be conveniently prepared in such a way that abutting the inner surface of cable insulation 62 against the inside surface of the connecting portion 41 brings the coaxial cable 6 into the correct position for preparing the contacts between the connecting portions 41 (and 42 if present) and the signal conductor 63 and the connecting portion 31,32 and the screen 61. The screen 61 may be prepared in accordance with DE-A-4116165 which is incorporated by reference. Once the coaxial cable 6 has been connected to the connecting device 100, the complete assembly can be stored prior to mounting to a PCB. The joining portion 5 holds the complete assembly so that even with movements of the cable 6 the relative positions of elongate members 1,2 are maintained. Joining portion 5 may of a size and strength and be otherwise adapted to provide strain relief to the cable. In FIG. 2 only further connecting portion 32 is shown but a similar further connecting portion 42 may be provided for connecting and securing to connecting portion 41. Connecting portions 31,32 and 41,42 cooperate to provide solid and substantially permanent connections to the cable 6.

Figure 3:
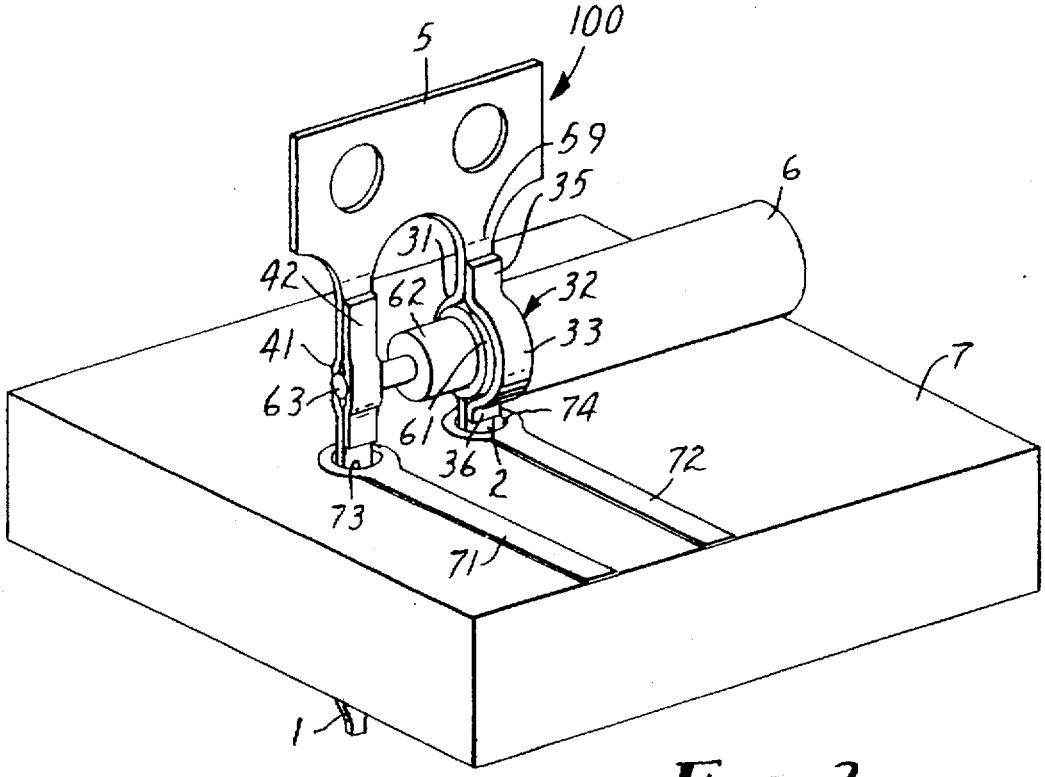
FIG. 3 shows the assembly of a coaxial cable, a printed circuit board and the connecting device in accordance with FIG. 1.

To install the coaxial cable 6 and connecting device 100 onto a PCB, the elongate members, 1,2 are inserted into the relevant holes 73 and 74 of the PCB 7 as shown in FIG. 3. Elongate members 1,2 may be electrically connected to the conductive paths 71, 72 on the PCB by press fit, by soldering or by any other suitable method. The cable 6, the connecting device 100 and the PCB 7 may be stored in the condition shown in FIG. 3 until the PCB is finished off. Joining portion 5 in conjunction with PCB 7 may hold cable 6 in a predetermined position with respect to both the connecting device 100 and the PCB 7. Further joining portion 5 provides the advantage of static control of any equipment or component attached either to the PCB or to the cable. Thus electromagnetic or electrostatic impulses, voltages or currents may be suppressed by the joining piece 5.

Figure 4:
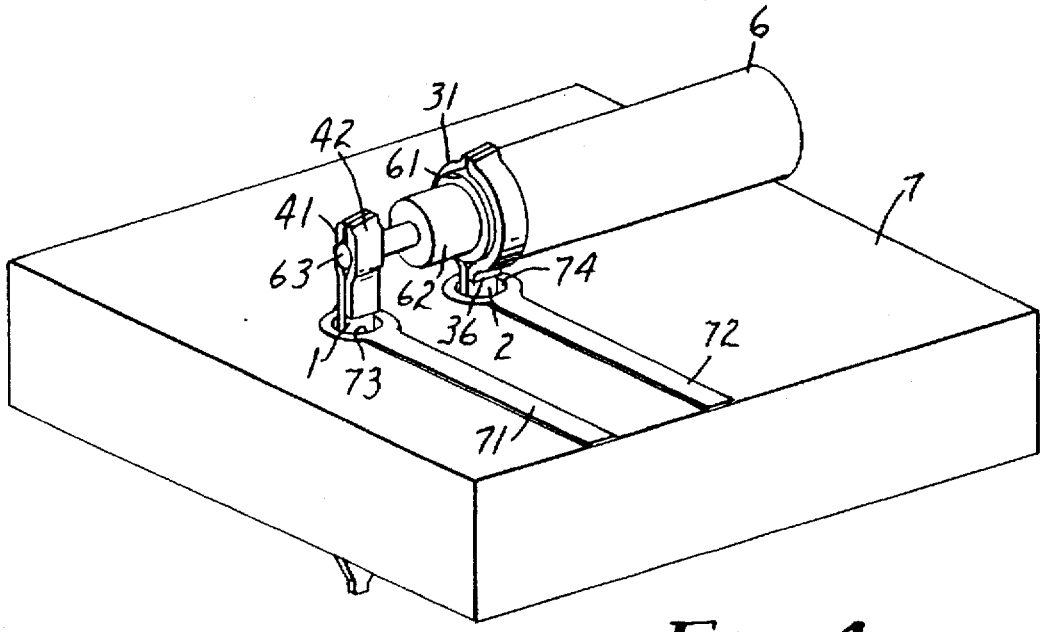
FIG. 4 shows the completed assembly of the connecting device in accordance with a first embodiment of the present invention, attached to a coaxial cable and a printed circuit board.

Prior to final assembly of the complete PCB, joining portion 5 is removed as shown in FIG. 4. Joining portion 5 may be removed by breaking along the weak points 59 shown in FIGS. 1 and 2 or may be cut off with snips or by means of an apparatus in accordance with the invention.

Figure 5B:
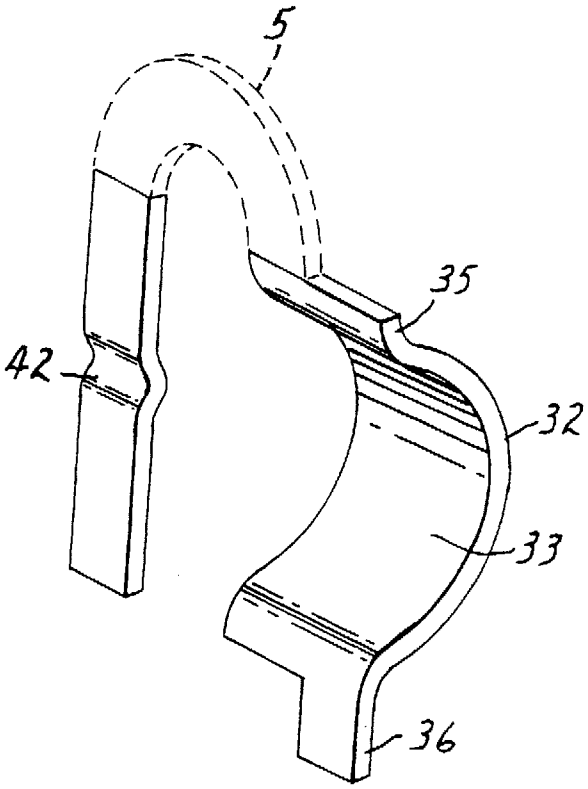
FIGS. 5A and 5B show modifications to the connecting device in accordance with the first embodiment of the present invention.
Figure 5A:
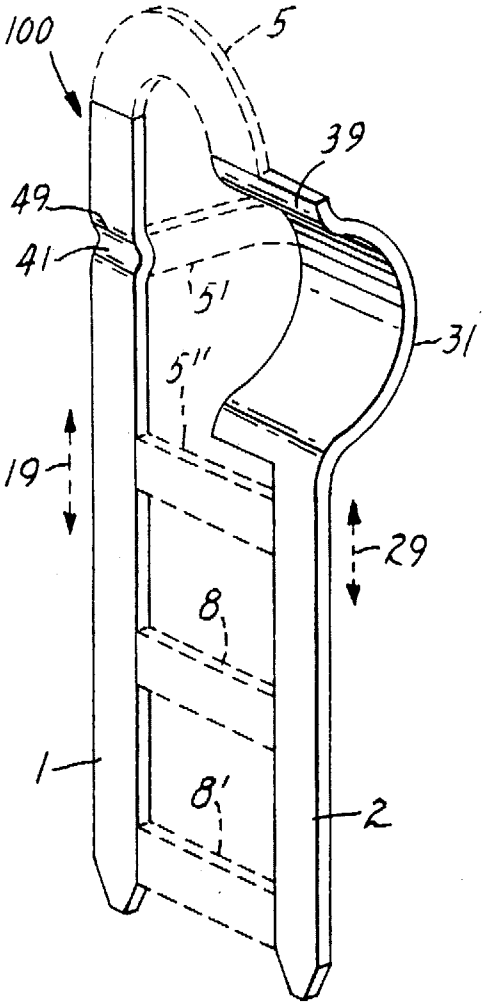

The joining portion 5 as shown in FIGS. 1 to 3 is joined to the ends of connecting portions 3 and 4. The invention is not limited thereto. As shown in FIG. 5A the connecting portion 5' may be provided between the connecting portions 31 and 41. Alternatively, the connecting portion 5" may be provided between portions 19,29 of the connecting device 100 which lie between the connecting portions 31,41 and the elongate members 1,2. As shown in FIG. 5B, the joining portion 5 may also be attached to further connecting portions 32,42.

In all the embodiments of the patent invention, the connecting portion 5, 5', 5" joins the connecting members 1,41,42; 2,31,32 so that a predetermined spatial relationship is maintained between them while leaving elongate members 1 and 2 and connecting portions 31,32 and 41,42 exposed and accessible. Joining portion 5,5',5" is located between first and second connecting members 1,41,42;2,31,32 so that the active lengths of elongate members 1,2, which have to be inserted into the PCB, are freely exposed. In addition to the joining portion 5,5',5", a further joining portion 8,8' may be provided for joining together elongate members 1,2 as shown in FIG. 5A. Further, joining member 8,8' provides additional mechanical support to the connecting device 100, as well as additional mechanical support when the connecting device 100 is joined to cable 6. Prior to installation on the PCB, the further joining portion 8,8' is removed by snipping it off or by providing weak points which allow the further joining portion 8,8' to be broken out.

Figure 6:
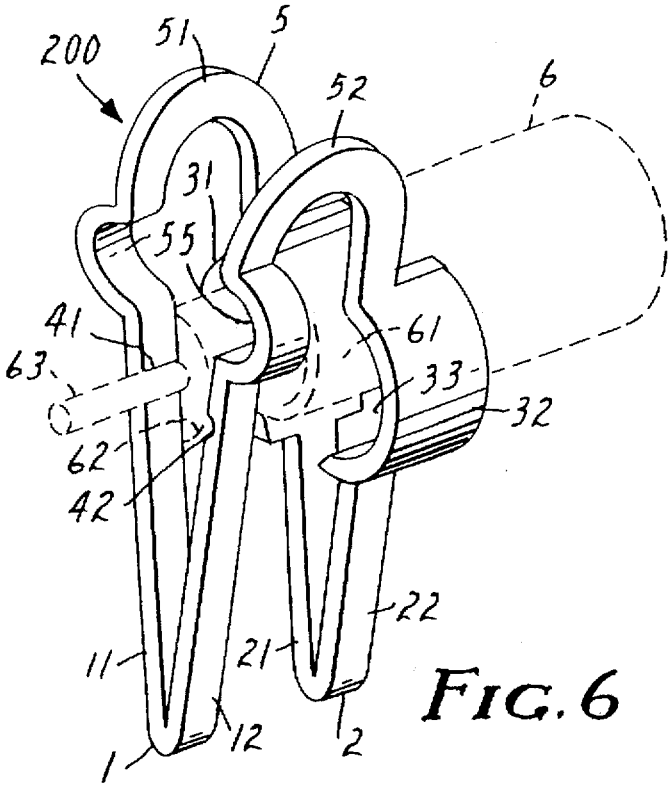
FIGS. 6 to 9 show a connecting device in accordance with a second embodiment of the present invention.

In all the embodiments of the invention, joining portion 5,5',5" and/or further joining portion 8,8' may be linked together with corresponding joining portions other connecting members 100 to form a strip. FIGS. 6 to 9 show the connecting device 200 in accordance with a second embodiment of the present invention. The same materials as used in the first embodiment may be used in the second embodiment and the connecting device 200 in accordance with the second embodiment may also be made by stamping and bending flat metal strip. Components with the same reference numbers in the first and second embodiments have the same function. Elongate members 1,2, connecting portions 3, 4 and joining portion 5 comprise in each case two halves 11,12;21,22;31,32;41,42; and 51,52. The two halves of the connecting device 200 may be joined together at the tips of the elongate members 1, 2. Connecting device 200 may be bent into a V-shape as shown in FIG. 6 which allows easy placement of cable 6. Bent portions 55 are provided in order to take up the difference in length of material between the connecting member 22,32 and connecting member 12,42 etc. so that elongate members 1,2 are the same length. The connecting portion halves 41, 42 may be provided with surfaces 49 which, in combination, are adapted to conform to the outer surface of the signal conductor 63. Connecting portion halves 31,32 may be provided with a surface 39 which is shaped in such a way as to conform to the screen 61 of cable 6.

Figure 7:
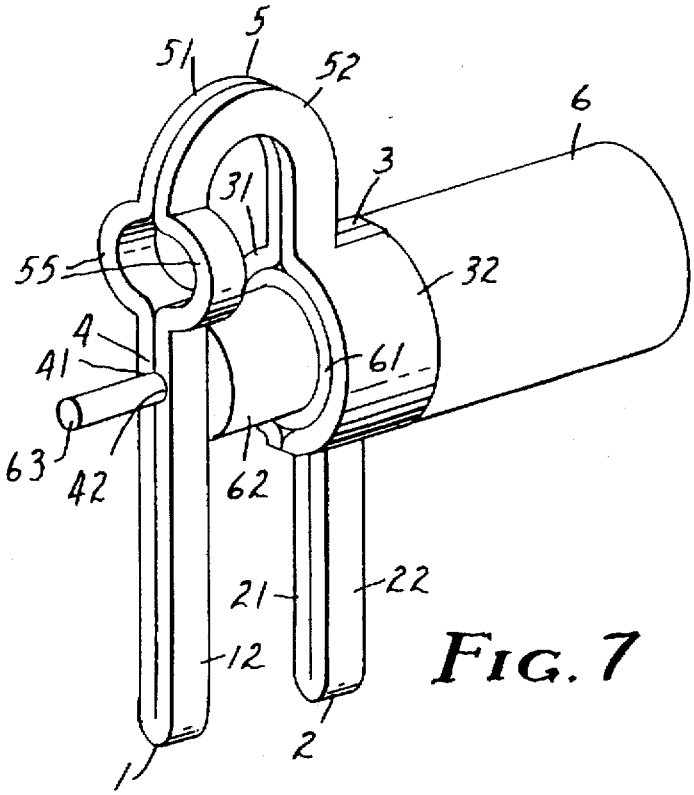

As shown in FIG. 7 the two halves of the connecting members 1,4;2,3 are brought together so that surfaces 49 and 39 come in contact with the signal conductor 63 and the screen 61 and are soldered, welded or spot-welded together so as to form a rigid construction. Thereby, connecting members 1,4 and 2,3 are electrically connected to the signal conductor 63 and to the screen 61 of the cable respectively. Joining portion 5 formed from the joining member halves 51,52, which may be soldered, welded or spot-welded together, may provide static control and/or strain relief of cable 6.

Figure 8:
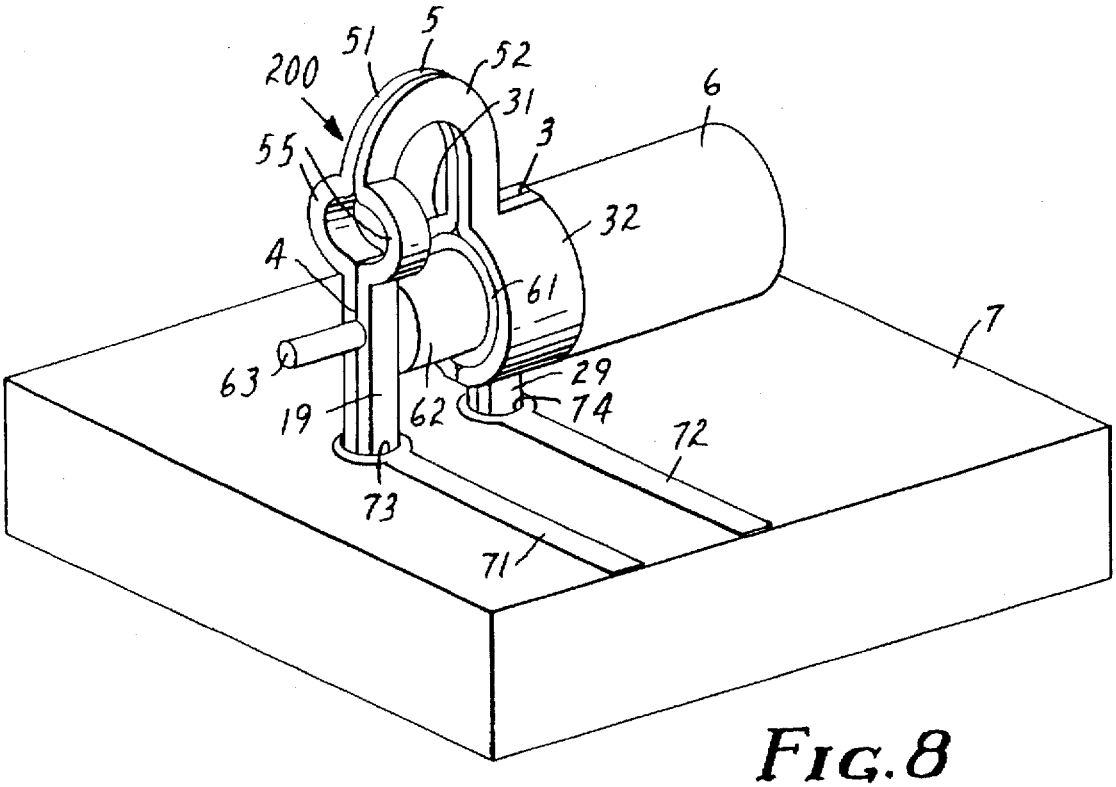
Figure 9:
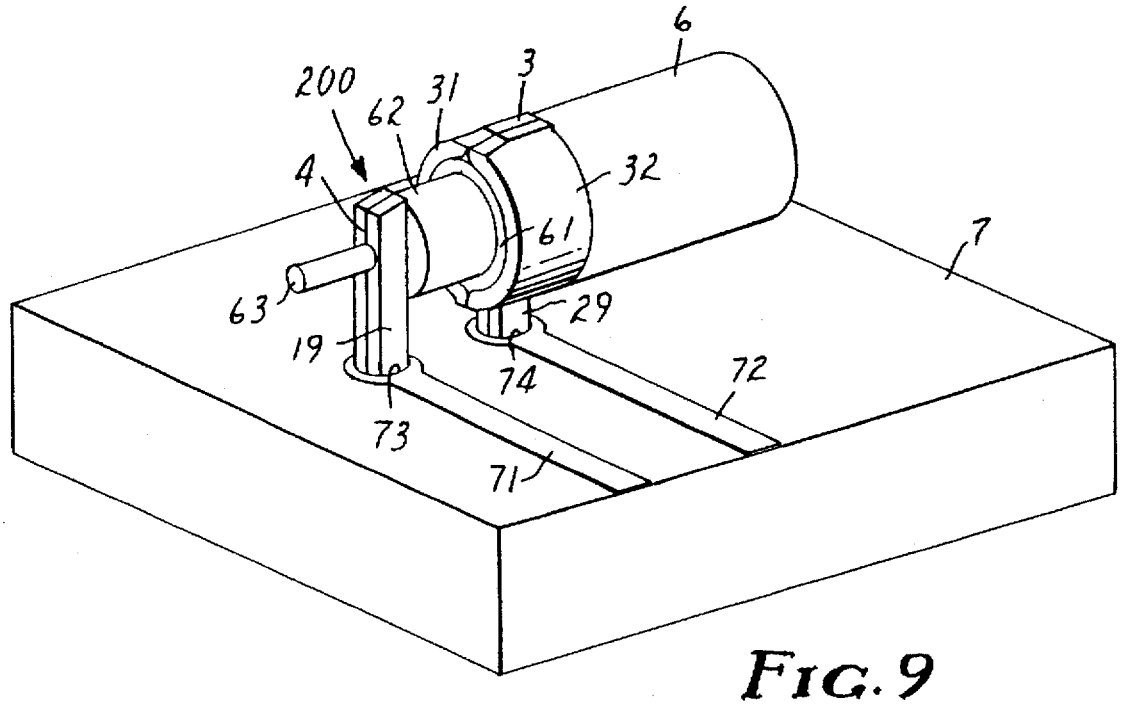

In a similar way to that described for the first embodiment, cable 6 connected to connecting device 200 is mounted onto the PCB 7 as shown in FIG. 8 and joining member 5 is cut-off or broken off as shown in FIG. 9. As shown in FIGS. 8 and 9 connection portions 4 and 3 may include extension portions 19 and 29 respectively so that when cable 6 is attached to the PCB 7, cable 6 is located at a predetermined height above the surface of PCB 7. Further, joining portion 5 may be provided between extension portions 19 and 29 rather than between the ends of connection portions 3 and 4 remote from elongate members 1,2 as described with reference to FIG. 5A.

Figure 10:
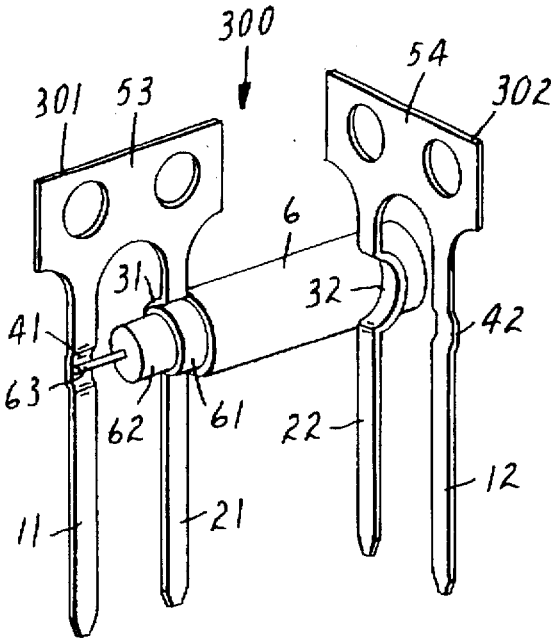
FIGS. 10 and 11 show an electrical connecting device in accordance with a third embodiment of the present invention.
Figure 11:
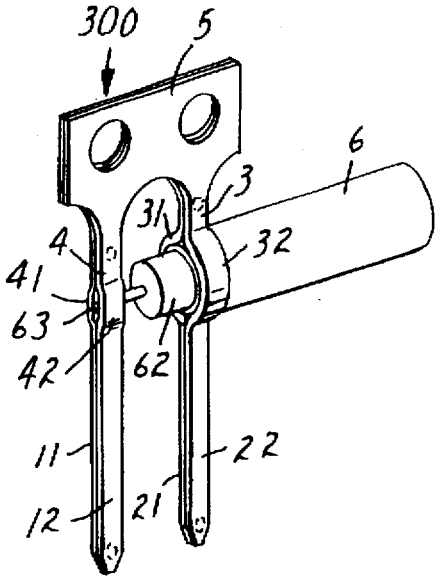
Figure 12:
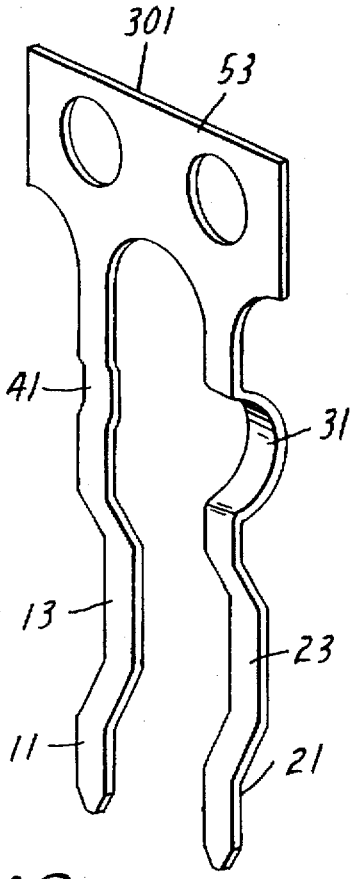
FIG. 12 shows a modification to the connecting device in accordance with a third embodiment of the present invention.

FIGS. 10 to 12 show a connecting device 300 in accordance with a third embodiment of the present invention. The materials used and described with respect to the first embodiment may be used in the third embodiment. Components with the same reference numbers in the first to third embodiments have the same function. The connecting device 300 includes two halves 301,302. Connecting device half 301 includes pins 11,21 and connecting portions 41 and 31 as well as joining portion half 53 which joins connecting portion 41 to connecting portion 31. In the same way connecting device half 302 includes pins 12,22, further connecting portions 32,42 and joining portion half 54. Connection portions 31,32;41,42 may be shaped to conform to, and substantially to surround the outer surface of the cable screen and signal conductor respectively. Connecting portions 31,32;41,42 may be wider than pins 11,12;21,22, or may be as wide.

Connecting device halves 301 and 302 may all be provided on a strip 53, 54 formed by manufacturing all the joining members 53,54 linked together. As shown in FIG. 11 cable 6 is connected to connecting device 300 by bringing the two halves 301, 302 together and welding, soldering or spot-welding these together in order to make connections to the signal conductor 63 and the screen 61. The remaining installation of the combined cable 6 and connecting device 300 is carried out in the same way as has been described for the first and second embodiments.

FIG. 12 shows a detail of the connecting half 301 of the connecting device 300 in accordance with the third embodiment. This connector half 301 is designed for pressfit connection into the holes 73,74 of the PCB 7. Pins 11,21 are provided with deformations 13,23 respectively. Similar deformations are provided in connecting device halve 302 so that when the two halves are joined together deformations 13,23 and their counterparts in the second connecting device half 302, allow sprung pressfit connection to holes 73,74 in PCB 7.

Figure 13:
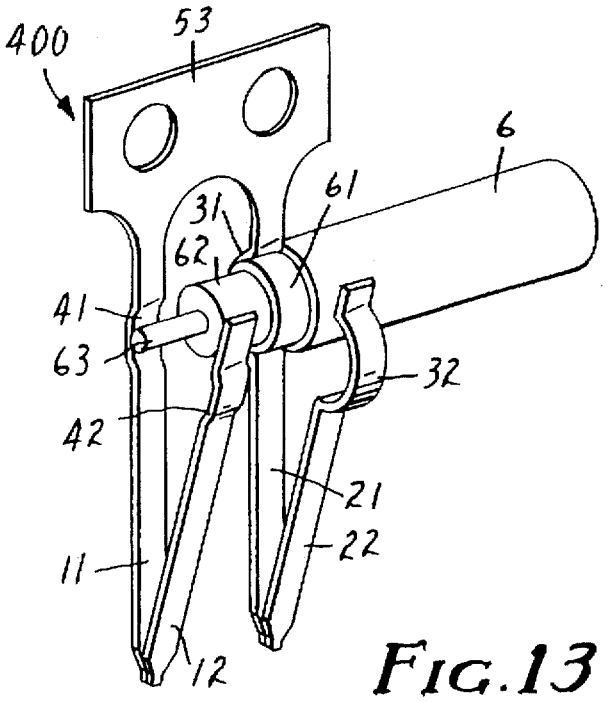
FIGS. 13 and 14 show a connecting device in accordance with a fourth embodiment of the present invention.
Figure 14:
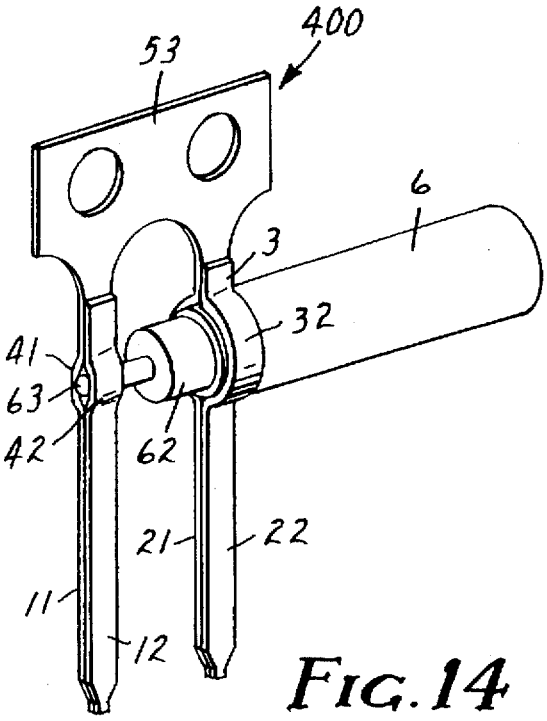

FIGS. 13 and 14 show a connecting device 400 in accordance with a fourth embodiment of the present invention. The materials used for the connecting device 400 may be the same as those used for the connecting devices 100,200,300 of the first to third embodiments. Components having the same reference numbers in the first to fourth embodiments have the same function. The connecting device 400 may be designed so that it may be manufactured by stamping and bending flat metal strip. The connecting device 400 is a modification of the connecting device 200 shown in FIG. 6. Connecting device 400 has only one joining portion 53 which joins connection portions 41,31. Cable 6 is installed on the connecting device 400 by closing the gap between pins 11,12 and 21,22 and by soldering or welding or spot-welding the halves, 11,41,31,21; 12,42,32, 22 to each other. The combined cable 6 and connecting device 400 are connected as shown in FIG. 14 and mounted to the PCB 7 as described with respect to the first to third embodiments. Joining portion 53 is removed as for the previous embodiments.

Figure 15:
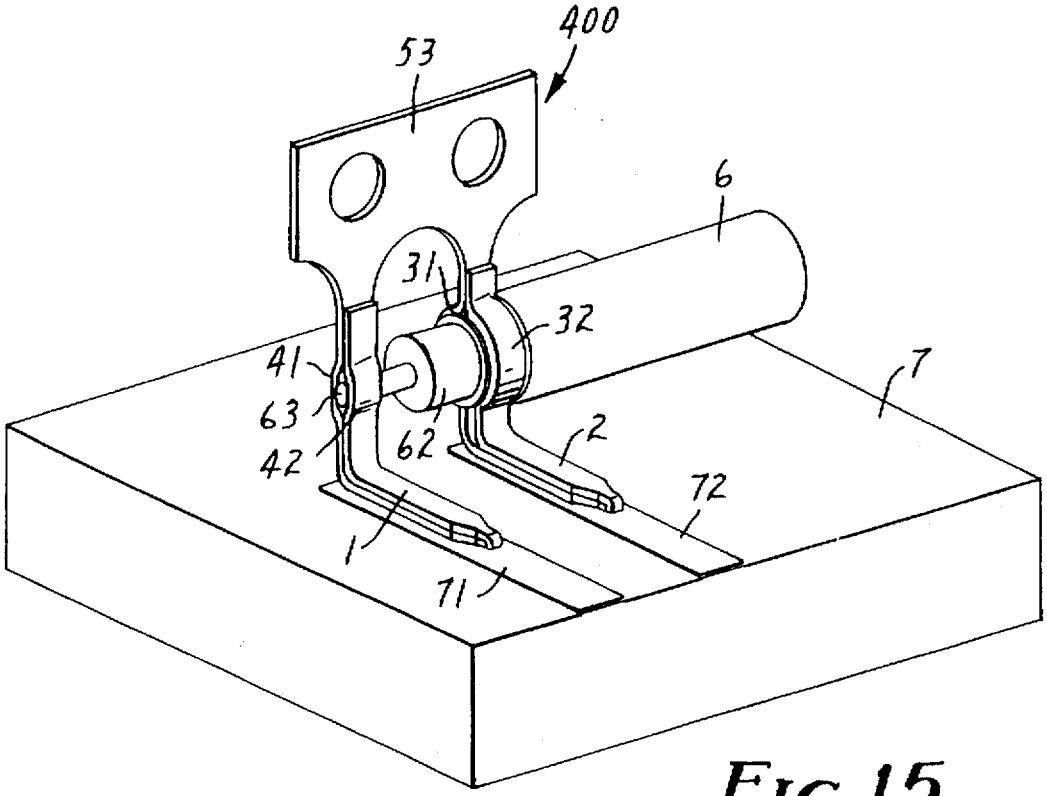
FIGS. 15 and 16 show modifications of a connecting device in accordance with the fourth embodiment of the present invention.
Figure 16:
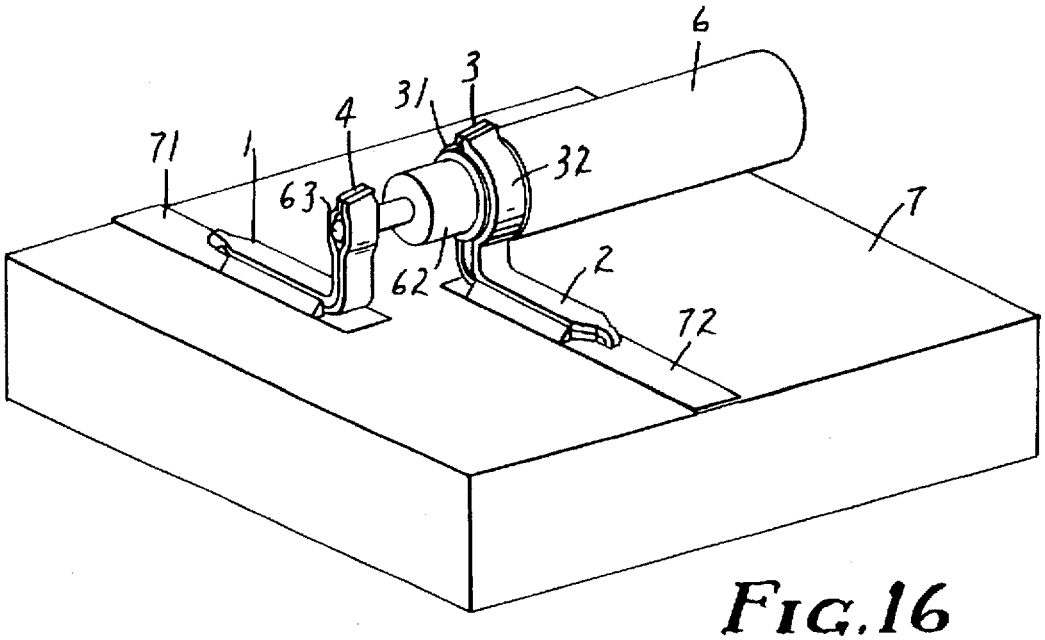

FIGS. 15 and 16 show two modifications which may be applied to any embodiment of the invention and is shown here as a modification to the connecting device 400 of the fourth embodiment. As shown in FIGS. 15 and 16, elongate members 1,2 are bent through an angle of about 90' and are attached to the conductive paths 71,72 of PCB 7 by soldering to the conductive paths 71,72 in a surface mount. The joining portion 53 is removed as described for the first to fourth embodiments. Elongate members 1,2 may be pre-bent to the required angle or bent after soldering, welding or spot-welding to cable 6.

Figure 17:
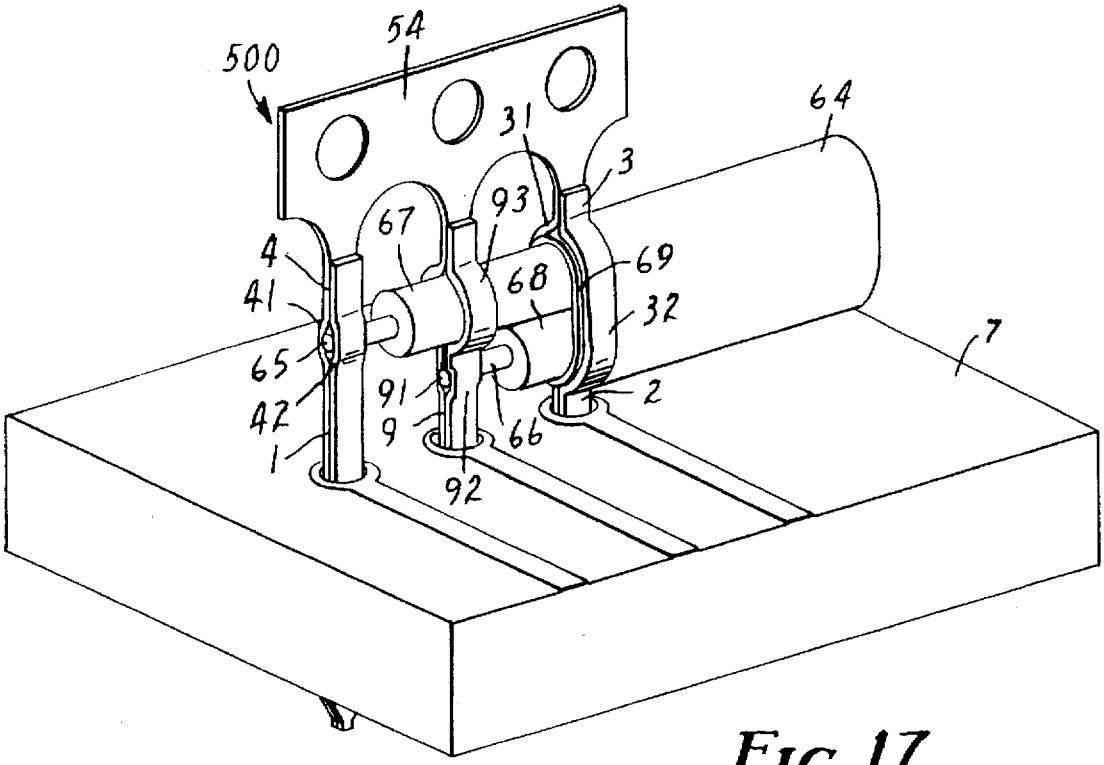
FIGS. 17 and 18 show a connecting device in accordance with a fifth embodiment of the present invention.
Figure 18:
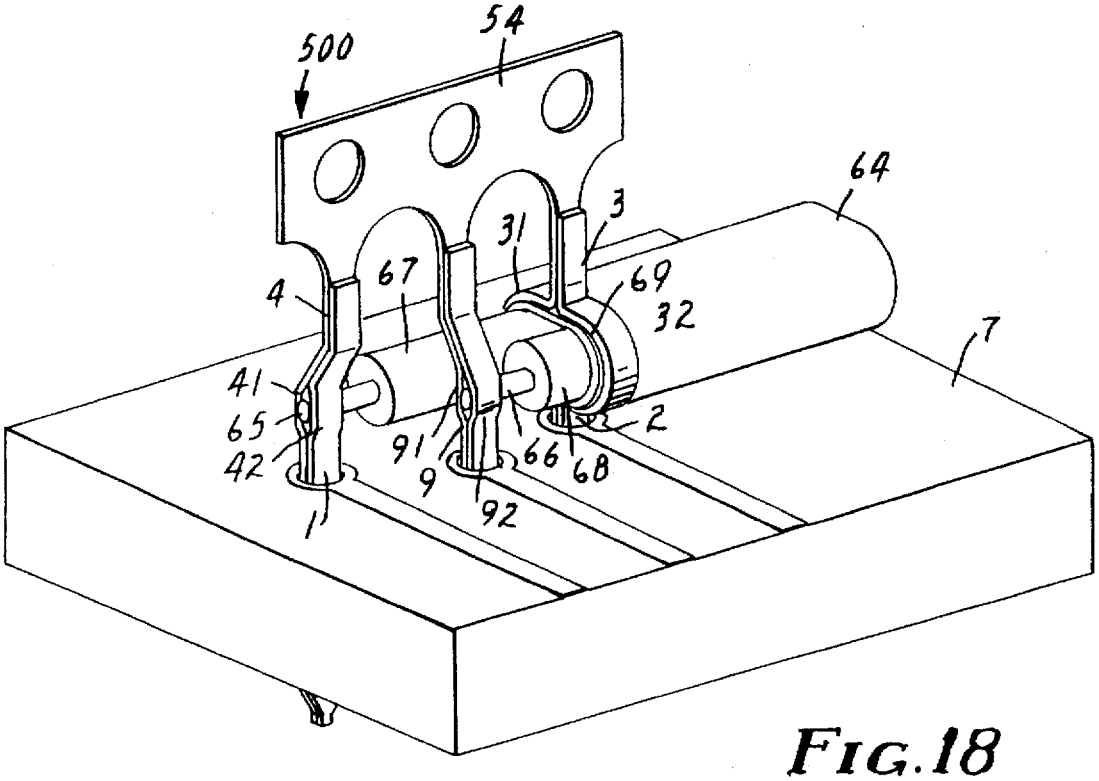

FIGS. 17 and 18 show a fifth embodiment of the present invention which may be adapted to any embodiment of the present invention. The connecting device 500 according to this embodiment may be made from the same materials as described with respect to the first to fourth embodiment. Cable 64 has two signal conductors 65,66 each of which has insulation 67,68. The cable 64 has a common screen 69. The connecting device 500 in accordance with the fifth embodiment is a modification of the connecting device 400 in accordance with the fourth embodiment. The connecting device 500 has elongate members 1 and 2, each connected to connecting portions 4 and 3 respectively for connection to the signal conductor 65 and the screen 69 respectively. An extra elongate member 9 is provided between elongate members 1 and 2. Elongate member 9 includes a connecting portion 91 and further connecting portion 92 for connection to the second signal conductor 66, as well as a portion 93 for accommodating the insulated core 67 of the first signal conductor 65. Elongate members 1,2 and 9 may be constructed in any of the ways described for embodiments 1,2,4. Joining portion 54 is removed to complete the installation as has been described for embodiments 1 to 4.

In FIG. 17, the two conductor coaxial cable (twinax) is mounted with the cores of the cable aligned perpendicular to the PCB. Connecting device 500 may be designed so that the cores of the twinax cable may be installed parallel to the surface of the PCB 7 as shown in FIG. 18. In accordance with this modification of the fifth embodiment, elongate member 9 is offset from the line joining elongate members 1 and 2.

Figure 19:
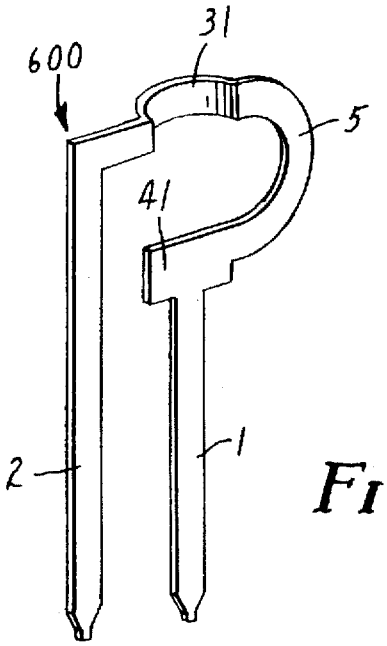
FIGS. 19 and 20 show a connecting device in accordance with a sixth embodiment of the present invention.
Figure 20:
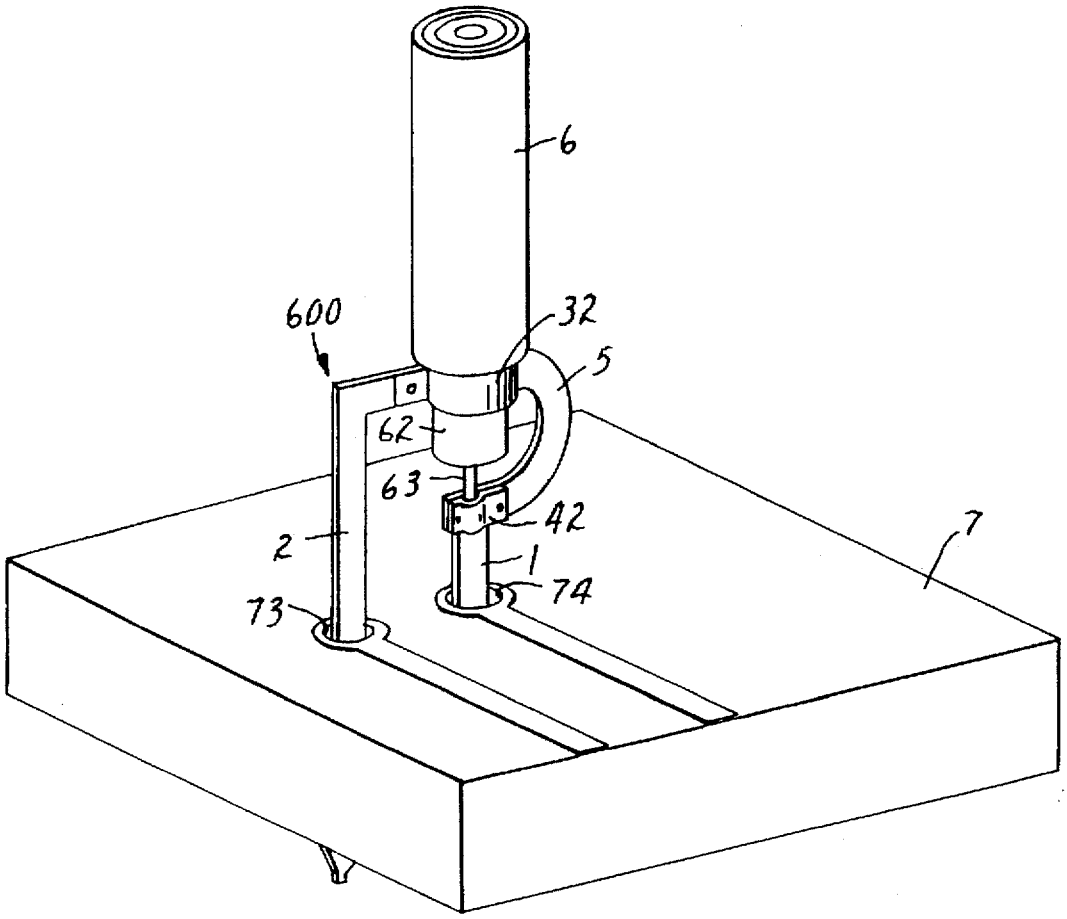

The connecting devices 100,200,300,400,500 in accordance with the first to fifth embodiment have been described, which allow installation of a cable 6,64 parallel to the surface of a PCB 7. The invention is not limited to this form of installation. In accordance with a sixth embodiment of the invention the connecting device 600 may be designed so that the cable is terminated perpendicular to the surface of PCB 7. As shown in FIG. 19 connecting device 600 consists of two elongate members 1 and 2 as well as connection portions 41 and 31 attached to pins 1 and 2 respectively and separate further connecting portions 32,42 (not shown). Joining portion 5 connects connection portions 31 and 41 together while leaving connection portions 31 and 41 and elongate members 1 and 2 exposed and freely accessible for termination of the cable. As shown in FIG. 20 the cable 6 is mounted on the connecting device 600 by soldering or welding the screen 61 of cable 6 to connection portions 31,32 and by soldering or welding the signal conductor 63 to connection portions 41,42. The combined assembly is then introduced into holes 73 and 74 of PCB 7 and terminated as described with respect to the first to fourth embodiments. To complete the installation joining portion 5 is cut-off or broken off as has been described for the first to fourth embodiments. It is advantageous if the connecting device 600 is designed so that the transition between the signal conductor 63 and the pin 1 does not include one or more right-angle bends. As shown in FIG. 19 the pin 1 is advantageously arranged so that the signal conductor 63 is in-line with the pin 1. This may reduce reflections of the signal at the signal conductor/connector connection.

Figure 21:
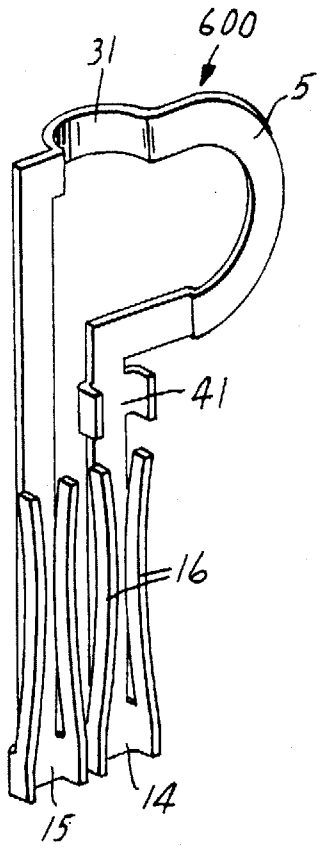
FIG. 21 shows a modification to a connecting device in accordance with a sixth embodiment of the present invention.

The first to sixth embodiments of the present invention have been described for installation on a conventional PCB. The invention is not limited thereto. The connecting device 600 shown in FIG. 21 is a modification of the connecting device 600 shown in FIG. 20, however the principle may be applied to any embodiment of the invention. Connecting device 600 has connecting portions 31 and 41 for connecting to the screen and signal conductor of a coaxial cable in cooperation with further connecting portions 32,42 (not shown). Socket portions 14,15 are connected to connecting portions 31,41, respectively. Socket portions 14,15 include arcuate contacting springs 16 for press fit contact to pins of a connector insertable therein. Connection portion 41 includes two flanges which may be crimped to the signal conductor of the coaxial cable.

Figure 22:
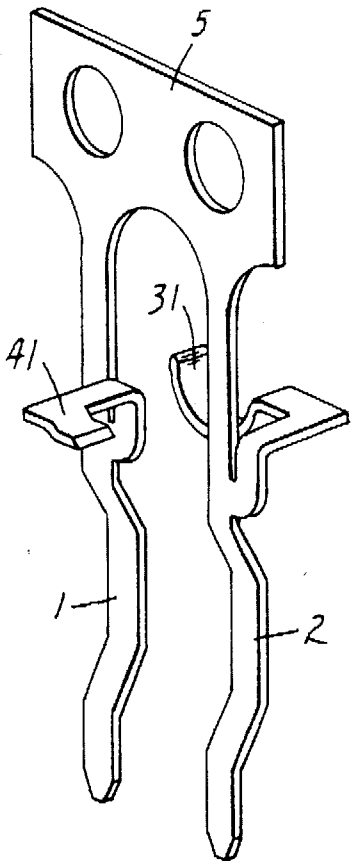

Embodiments 1 to 6 of the present invention have been described in which cable 6,64 is mounted on a PCB 7 such that the axis of the cable is parallel to the line joining elongate members 1,2. The invention is not limited thereto. As shown in FIG. 22, the connecting device in accordance with the invention may be adapted so that cable 6 may be mounted perpendicular to the line joining elongate members 1,2. The remainder of the installation is the same as has been described for the first to fourth embodiments of the present invention.

Figure 23:
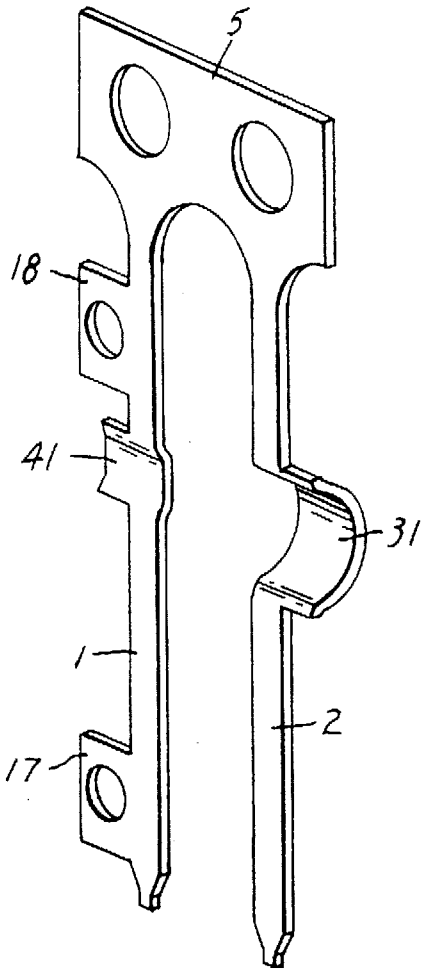
FIGS. 22 to 23 show further general modifications to a connecting device in accordance with the present invention.

FIG. 23 shows a modification of the connecting device in accordance with the present invention which may be applied any of the embodiments of the invention. One or both of pins or elongate members 1,2 may be provided with a protrusion 17 which is wide enough to prevent pins 1 or 2 from being introduced into holes 73, 74 of the PCB. With this embodiment cable 6, 64 is connected to the connecting device in accordance with any of the first to sixth embodiments of the invention. The protrusion 17 is cut-off preferably by the apparatus in accordance with the present invention, which allows the combined connecting device and cable to be introduced and terminated to the PCB. Joining portion 5 is then removed, preferably by the apparatus in accordance with the present invention. As an alternative to the protrusion 17, one or both of pins or elongate members 1,2 may be extended in length and then bent at an angle in order to prevent insertion of pins 1 or 2 into the PCB at tab 18. To install, the excess length is cut-off.

Figure 25:
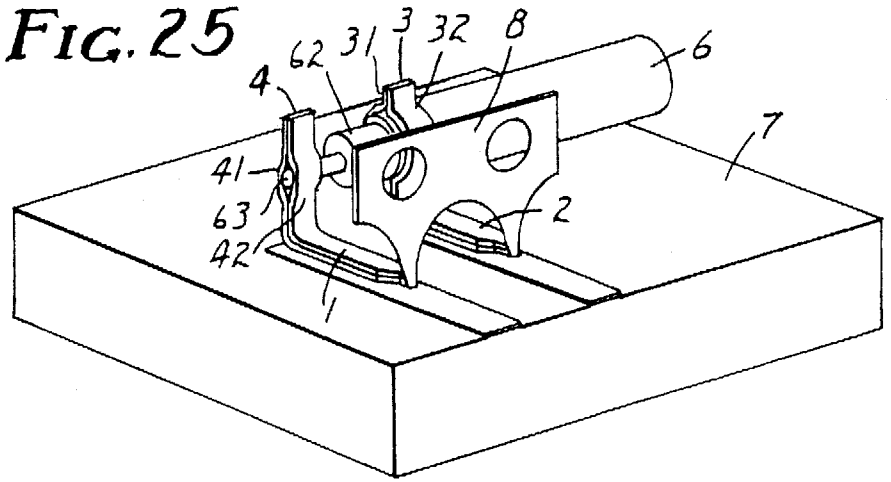
FIGS. 24 to 26 show a connecting device in accordance with a seventh embodiment of the present invention.
Figure 26:
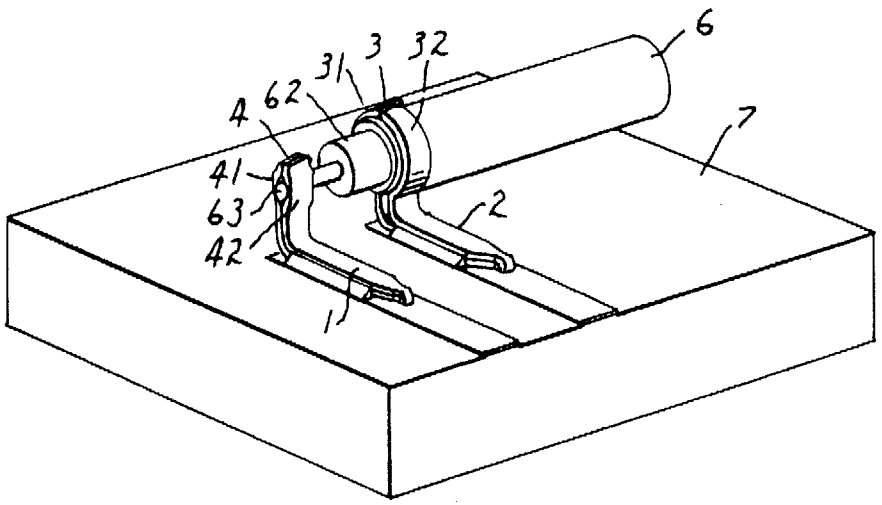
Figure 24:
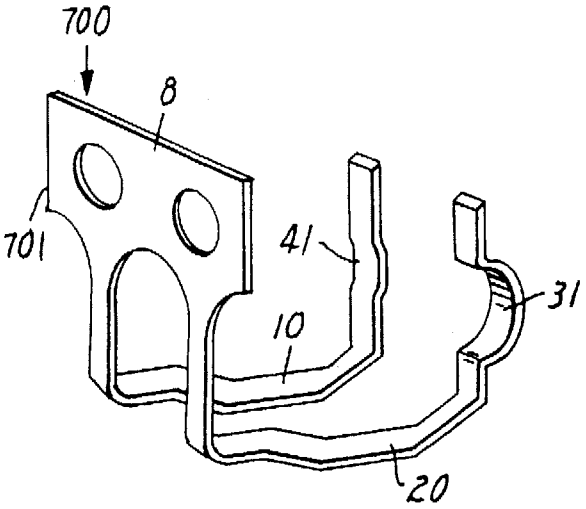

FIGS. 24 to 26 show a seventh embodiment of the present invention. The materials used for the first to sixth embodiments may be used for the seventh embodiment. Components with the same reference numbers in the first to seventh embodiments have the same function. FIG. 24 shows one half 701 of a connecting device 700 in accordance with the seventh embodiment. The second half 702 (not shown) is made to match the first half 701 as described for halves 301 and 302 of the third embodiment. The connecting device half 701 includes connecting portions 31 and 41 for connecting the screen and signal conductor of a coaxial cable. The extensions 10,20 of portions 31,41 are bent at an angle approximately 90' to the plane of portions 31,41. Portions 10,20 are for surface mounting of connecting device 700 as shown in FIG. 25. Joining portion 8 is provided for holding portions 41,10;31,20 in a predetermined spatial relationship to each other. After surface mounting, joining portion 8 is cut or broken off as shown in FIG. 26.

Figure 27:
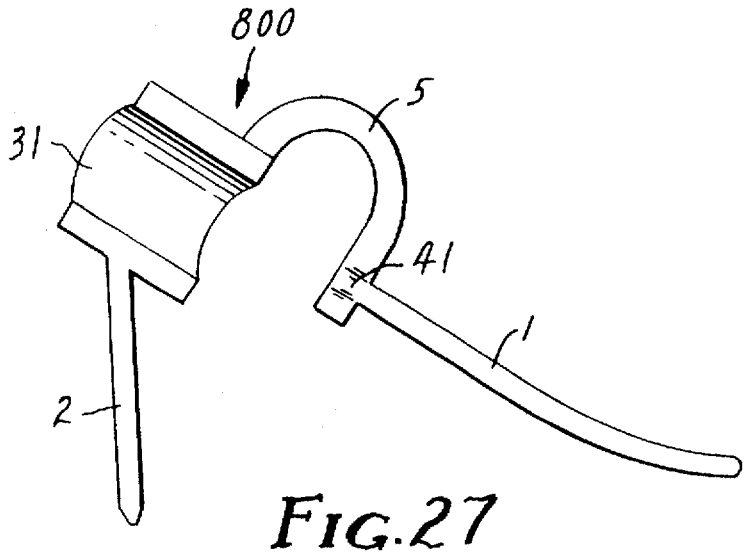
FIGS. 27 and 28 show a connecting device in accordance with an eighth embodiment of the present invention.
Figure 28:
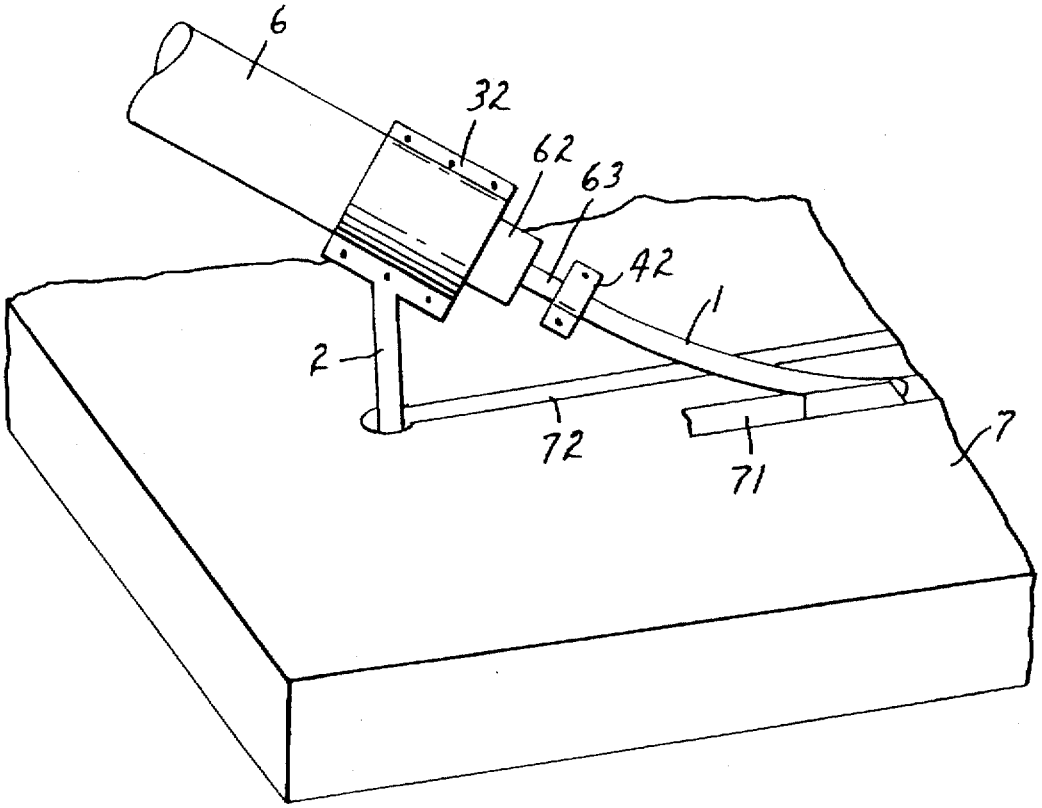

FIGS. 27 and 28 show an eighth embodiment of the connecting device 800 according to the present invention. Any of the materials used in the first to seventh embodiments may be used in the eighth embodiment. Connecting device 800 may include a pin 2 and a shaped elongate member 1. Integral with the pin 2, a connecting portion 31 is provided which is adapted to conform to a part of the circumference of the screen of a coaxial cable. A connecting portion 41 for the signal conductor is also provided integral with shaped elongate member 1. A joining portion 5 joins connecting portion 31 with connecting portion 41. As shown in FIG. 28, the elongate member 1 is shaped so that there is a smooth transition from the signal conductor 63 to the surface mount on the conductive path 71 of PCB 7. This may reduce reflections of signals at the connector/PCB boundary. Pin 2 is soldered to PCB through the hole 74. The screen 61 of cable 6 is connected to the connecting device 800 with connecting portion 31 and further connecting portion 32 as described for the previous embodiments. The signal conductor 63 is connected to pin 1 by means of the connecting portion 41 and further connecting portion 42 as described previously. Finally, joining portion 5 is cut-off.

In the connecting device according to the first to eighth embodiments described above, the connecting portions 3,4 for connection to the screen and signal conductor respectively comprise connecting portions 31,41 and further connecting portions 32,42. Connecting portions 31,41 are adapted to conform to a part of the circumference of the relevant one of the cable screen and the signal conductor and further connecting portions 32,42 are adapted to conform to substantially the remaining part of the circumference of the cable screen or signal conductor. This construction allows the connecting device in accordance with the present invention to be manufactured from sheet metal by simple and cost effective stamping and bending processes. Further, the separation of the connecting surfaces into connecting portions 31,41 and further connecting portions 32,42 allows easy access to these surfaces for connection to the cable. In particular it is not necessary with the connecting device in accordance with the invention to push cable with easily splayed braided cable screens through narrow openings such as heat shrinkable tubes. The easily accessible construction allows the use of welding or spot welding techniques to connect connecting and further connecting portions 31,41;32,42 to each other and to the cable. This allows the process to be automated and reduces manufacturing cost. Further, the number of components in the connecting device is low.

As described with reference to the first to eighth embodiments of the present invention, the joining member 5 or the further joining member 8 is made from a conductive material, normally a metal. The invention is not limited thereto. The joining member 5 or 8 may be insulating and may be manufactured by injection molding, especially insertion molding or by dipping in molten plastic or in a solution of an insulating material such as a plastic.

Figure 29:
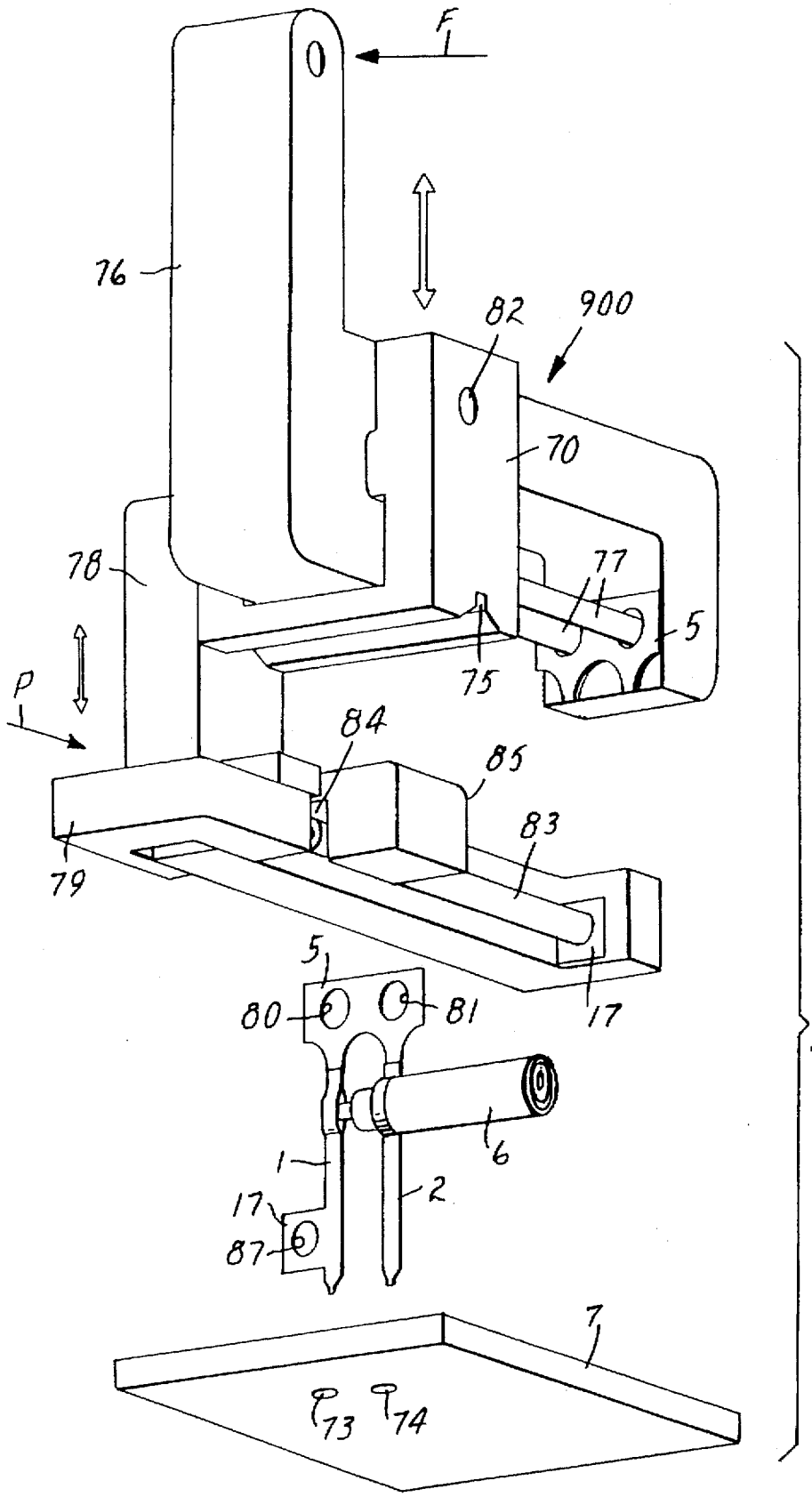
FIG. 29 shows an apparatus in accordance with a ninth embodiment of the present invention.

FIG. 29 shows an apparatus 900 according to a ninth embodiment of the present invention, for installing the connecting device 1–5 according to the present invention connected to cable 6, on a further electrical component, particularly a printed circuit board. The apparatus 900 includes a head 70 having a slit 75 for receiving the joining portion 5 of the connecting device in accordance with the present invention. Movable holding and cutting device 76 may then be moved in the direction F to a first position by any suitable actuator to hold connecting device 1–5 and cable 6 using holes 80,81 in joining portion 5 as a reference. The additional tab 18 shown in FIG. 23 may also be used to locate the connecting device with respect to the apparatus 900. Holding and cutting device 74 may be journalled on an axle 82 so that it rotates thereabout. Head 70 is then lowered to insert the pins 1,2 of the connecting device 1–5 into the holes 73,74 of the PCB 7. The pins may then be soldered to the conducting paths 71,72. Holding and cutting device 76 is then moved further to a second position to shear off joining portion 5 against cutting edge 85 of head 70 and for pushing severed portion 5 onto the rods 77 for storage and disposal. Apparatus 900 may also include a second head 78 movably attached to the first head 74. Second head 78 includes a second slit 84 for receiving a protrusion 17 having a hole 87 as described with respect to FIG. 23. Second head 78 includes a second cutting device 79. After holding and cutting device 76 has been moved to the first position to hold connecting device 1 to 5, second cutting device 79 is moved in the direction P by any suitable actuator to sever protrusion 17 from one of pins 1 or 2 against cutting edge 86 and for pushing the severed protrusion 17 onto rod 83 for storage and disposal. First head 70 is then lowered with respect to second head 78 to install the pins 1,2 into the holes 73,74 of PCB 7.

I claim:

1. Device for electrically connecting at least one cable having at least two conductive members to another electrical component, said device comprising:

at least first and second connection members, said first connection member including:

a first portion electrically connectable to a first conductive member of the cable;

and a second portion electrically connected to said first portion and electrically connectable to said another electrical component;

said second connection member including:

a third portion electrically connectable to a second conductive member of the cable; and a fourth portion electrically connected to said third portion and electrically connectable to said another electrical component; and said device further comprising:

a joining portion made from electrically conductive material and electrically connecting said first and third portions;

at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being securable and electrically connectable to the respective ones of said first and third portions.

2. Device according to claim 1 wherein said fifth portion is substantially permanently attached to the respective one of said first and third portions.

3. Device according to claim 1, wherein said joining portion is adapted to hold said second and fourth portions in a predetermined spatial relationship to each other.

4. An assembly including a device according to claim 1, wherein said second and fourth portions are connected to the another electrical component.

5. Device according to claim 1, wherein said joining portion is adapted to provide strain relief for the cable.

6. Device according to claim 5, wherein said joining portion is separable from said first and second connection members.

7. Device for electrical connection to another electrical component, said device comprising:

a cable having at least two conductive members;

at least first and second connection members, said first connection member including:

a first portion electrically connected to a first conductive member of the cable; and a second portion electrically connected to said first portion and electrically connectable to said another electrical component;

said second connection member including:

a third portion electrically connected to a second conductive member of the cable; and a fourth portion electrically connected to said third portion and electrically connectable to said another electrical component; and said device further comprising:

a joining portion made from electrically conductive material and electrically connecting said first and third portions; at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being secured and electrically connected to the respective one of said first and third portions.

8. Apparatus for installing a connecting device in accordance with claim 7, comprising:

means for holding the joining portion;

means for inserting the connecting device in the further electrical component; and means for removing the joining portion from the connecting device.

9. Device for electrically connecting at least one cable having at least two conductive members to another electrical component, said device comprising:

at least first and second connection members, said first connection member including:

a first portion electrically connectable to a first conductive member of the cable; and a second portion electrically connected to said first portion and electrically connectable to said another electrical component;

said second connection member including:

a third portion electrically connectable to a second conductive member of the cable; and a fourth portion electrically connected to said third portion and electrically connectable to said another electrical component; and said device further comprising:

ends of said first and third portions remote from said second and fourth portions being fixed to a joining portion, said joining portion holding said first and second connection members in a predetermined spatial relationship to each other;

at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being securable and electrically connectable to the respective one of said first and third portions.

10. Device according to claim 9, wherein said second and fourth portions are elongate members, each elongate member comprising a first pin and a second pin, an end of each first pin being connected to the respective one of said first and third portions, said fifth portion comprises sixth and seventh portions and said sixth and seventh portions are connected to an end of the respective second pins.

11. Device according to claim 9, wherein said second and fourth portions are elongate members, each elongate member comprises a first pin and a second pin, a first end of each first pin being connected to the respective one of said first and third portions, and a second end of each first pin being joined to a first end of one said second pin, and said fifth portion comprises sixth and seventh portions, said sixth and seventh portions each being joined to a second end of the respective ones of said second pins.

12. Device according to claim 11, wherein said joining portion includes a conductive joining member between said sixth and seventh portions.

13. Device according to claim 12, wherein at least one of said second and fourth portions includes a protrusion which prevents connection to the another electrical component.

14. Device according to claim 13, wherein said first portion is connectable to the signal conductor of a cable; the second portion is an elongate member and the fourth and fifth portions are adapted so that the signal conductor and the second portion are axially aligned.

15. Method of connecting a device to a cable and a further electrical component, said device comprising:

at least first and second connection members, said first connection member including:

a first portion electrically connectable to a first conductive member of the cable; and a second portion electrically connected to said first portion and electrically connectable to the further electrical component;

said second connection member including:

a third portion electrically connectable to a second conductive member of the cable; and a fourth portion electrically connected to said third portion and electrically connectable to the further electrical component; and said device further comprising:

a joining portion made from electrically conductive material and electrically connecting said first and third portions;

at least one of said first and third portions being adapted to conform to a part of the circumference of the respective one of said first and second conductive members of the cable; and a fifth portion made from electrically conductive material and adapted to conform to substantially the remaining part of the circumference of said at least one of said first and second conductive members, said fifth portion being securable and electrically connectable to the respective one of said first and third portions;

the method including the steps of:

connecting a cable to said first, third and fifth portions including the step of joining the fifth portion to the respective ones of the first and third portions; and connecting the further electrical component to said second and fourth portions;

followed by the step of removing said joining portion.

* * * * *